US006760446B1

(12) United States Patent
Miller

(10) Patent No.: US 6,760,446 B1
(45) Date of Patent: Jul. 6, 2004

(54) POINT SOURCE SPEAKER SYSTEM

(76) Inventor: Francis Allen Miller, 1918 A Broadway, Alameda, CA (US) 94501

( * ) Notice: Subject to any disclaimer, the term of this patent is extended or adjusted under 35 U.S.C. 154(b) by 0 days.

(21) Appl. No.: 09/678,977

(22) Filed: Oct. 5, 2000

Related U.S. Application Data

(63) Continuation of application No. 09/173,606, filed on Oct. 14, 1998, now Pat. No. 6,169,812.

(51) Int. Cl.[7] ..... H04R 5/00; H04R 5/02

(52) U.S. Cl. ..... 381/1; 381/99; 381/303; 381/300

(58) Field of Search ..... 381/1, 17–19, 381/300, 89, 99, 98, 27

(56) References Cited

U.S. PATENT DOCUMENTS

| | | | | |
|---|---|---|---|---|
| 3,022,377 A | | 2/1962 | Bobb | 381/150 |
| 3,582,553 A | | 6/1971 | Bose | 381/87 |
| 3,617,654 A | | 11/1971 | Heidrich | 381/351 |
| 3,892,624 A | | 7/1975 | Shimada | 381/1 |
| 4,058,675 A | | 11/1977 | Kobayashi et al. | 381/304 |
| 4,379,951 A | | 4/1983 | Gabr | 381/431 |
| 4,497,064 A | | 1/1985 | Polk | 381/304 |
| 4,638,505 A | | 1/1987 | Polk et al. | 381/99 |
| 4,819,269 A | | 4/1989 | Klayman | 381/303 |
| 4,847,904 A | | 7/1989 | McShane | 381/89 |
| 4,888,804 A | | 12/1989 | Gefvert | 381/304 |
| 4,961,226 A | | 10/1990 | Saffran | 381/303 |
| 4,984,273 A | * | 1/1991 | Aylward et al. | 381/1 |
| 5,321,756 A | | 6/1994 | Patterson, Jr. et al. | 381/89 |
| 5,374,124 A | | 12/1994 | Edwards | 381/89 |
| 5,533,129 A | | 7/1996 | Gefvert | 381/300 |
| 5,553,147 A | | 9/1996 | Pineau | 381/89 |
| 5,610,986 A | | 3/1997 | Miles | 381/27 |
| 5,796,854 A | | 8/1998 | Markow | 381/89 |
| 6,219,426 B1 | * | 4/2001 | Daniels et al. | 381/307 |

FOREIGN PATENT DOCUMENTS

| | | | |
|---|---|---|---|
| JP | 63-318900 | 12/1988 | H04R/5/033 |

* cited by examiner

*Primary Examiner*—Xu Mei
(74) *Attorney, Agent, or Firm*—Mitchell S. Rosenfeld; Capstone Law Group LLP

(57) ABSTRACT

The system of the present invention includes, briefly, a point source speaker system, comprising a processor which produces a left minus right (L–R) audio signal, a right plus left (R+L) and a right minus left (R–L) audio signal; three speakers each for audibly transmitting one of the L–R, R+L and R–L audio signals; and a point source speaker enclosure for housing the three speakers in a single enclosure.

29 Claims, 4 Drawing Sheets

POINT SOURCE SPEAKER SYSTEM

This application is a continuation of U.S. patent application No. 09/173,606 filed Oct. 14, 1998 now U.S. Pat. No. 6,169,812 which files are hereby incorporated by reference.

TECHNICAL FIELD

This invention relates generally to a point source speaker system and more particularly the application of the principles of wave interferometry to the reproduction of stereophonic sound via a point source speaker enclosure.

BACKGROUND ART

Traditionally, audiophiles have focused on the use of two or more speaker systems. Usually, arranged with one speaker to the left of center, another to the right, and a non-directional subwoofer for low band sounds. With the increasing popularity of home entertainment systems and surround sound, additional speakers are added to the system in an attempt to surround the listener with sound for a more life-like experience.

These traditional systems suffer from a number of defects. Most obviously, these systems are cumbersome and require a large amount of space. Some systems utilize six or more speakers, which must be placed in a particular arrangement within the listener's room. Additionally, speakers must be placed in appropriate locations in order to avoid undesirable effects on the sound quality. For example, placing speakers too close to a corner in a room produces reflections which undesirably alter to sound propagation pattern of the speaker.

The best arrangement of speakers in a room is to position the listener and the speakers in an arrangement that forms an isosceles right triangle with the angle at the vertice of the listener being 90° and the speakers being at the vertices along the base of the triangle. In practice, the distance between the speakers and the listener may vary as long as the angle at the vertice of the listener is maintained at 90°.

Even in this ideal set-up, significant problems arise that negatively impact the listener's experience. Each speaker emits a separate acoustic wave. According to the principles of wave theory, the separate waves will interact within the space-time domain to form a resultant wave form that is dependant on the phase of the original waves at particular points in the space-time domain. The interaction will be constructive in the areas of phase alignment creating an increased signal or bright spot. At points where the phase between the two original waves is 180° out of phase the interaction is destructive creating null or dead spots.

This wave interference phenomenon is akin to the effects created by a light interferometer which demonstrates the wave properties of light. A light beam is split by transmitting the light from a single source through two or more slits. The light output from the slits forms a series of bright rings where the light from each slit is in phase and dark rings where the light from each slit is out of phase.

As a result of this phenomenon as applied to acoustic waves from traditional stereo speakers, the position of the listener in the acoustic wave interference pattern determines the quality of the sound heard by the listener. Thus, if the listener is positioned at a point where the acoustic waves from the speakers are out of phase, the listener will perceive the area as a dead spot.

Additionally, the phenomenon results in what has been coined by some in the audio industry as a "comb filter effect". This term is borrowed from the field of electronics to describe a particular type of filter in which the filter throughput diagram is shaped like a comb. If a listener moves their head back and forth while listening to conventional speakers, their ears will pass through alternately pass through bright spots and dead spots (i.e., areas where the acoustic waves are in phase and out of phase, respectively. As a result the sound heard by the listener fades in and out as the listener's head moves.

Additionally, the standard two or three speaker (the third being a subwoofer) speaker arrangement also suffers the additional defect of having a weak center channel. This is partially remedied in surround sound speaker set-ups by adding a center speaker, but this utilizes additional space in the room and increases the cost of the system.

SUMMARY OF THE INVENTION

The present invention eliminates these defects through the use of, a point source speaker enclosure and interferometric processing of the L and R stereo signals.

In accordance with the illustrated preferred embodiment, the present invention provides a novel, cost effective point source speaker system.

It is an object of the invention to provide a point source speaker system for reproducing stereophonic sound.

Another object of the invention is to provide a point source speaker system which utilizes the principles of wave interferometry.

An additional object of the invention is to provide a speaker system which is compact without sacrificing sound quality.

It is also an object of the invention to eliminate the problem of dead spots which is inherent in all multiple speaker systems.

An object of the present invention is to provide a point source speaker having a high degree of spatial separation between the left and right stereo channels and a strong center channel.

Another object of the present invention is to eliminate the comb filter effect which is inherent in conventional speaker systems.

Additionally, it is an object of the present invention to provide a high quality speaker system that makes efficient use of space.

The system of the present invention includes, briefly, a point source speaker system, comprising a processor which produces a left minus right (L−R) audio signal, a right plus left (R+L) and a right minus left (R−L) audio signal; three speakers each for audibly transmitting one of the L−R, R+L and R−L audio signals; and a point source speaker enclosure for housing the three speakers in a single enclosure.

The present invention has other objects ad advantages which are set forth in the description of the Best Mode of Carrying Out the Invention. The features and advantages described in the specification, however, are not all inclusive, and particularly, many additional features and advantages will be apparent to one of ordinary skill in the art in view of the drawings, specification, and claims herein.

BEST MODE OF CARRYING OUT THE INVENTION

The present invention makes use of the principles of wave interferometry to provide stereophonic sound from a point source speaker enclosure. As defined herein, wave interferometry is the principle of the effect that multiple waves such as light or this case acoustic interfere with each other in a manner that may be complementary or destructive.

The preferred embodiment makes use of wave interferometry principles by utilizing a point source speaker with three speakers, namely a left, right and center speaker. Stereophonic signals comprise two channels, left (L) and right (R). Throughout this specification and drawings the abbreviations L and R will be used to refer to the left and right stereo signals, respectively. In the preferred embodiment, the left speaker receives as an input signal L−R (that is the left stereo signal minus the right signal); the right speaker receives as an input signal R−L (that is the right stereo signal minus the left stereo signal); and the center speaker receives as an input signal R+L (that is the right signal plus the left signal). The interferometric properties of the acoustic waves produced by the pont source is discussed below in detail with respect to FIG. 6. Next the overall structure of the preferred embodiment is discussed.

Figure 1:
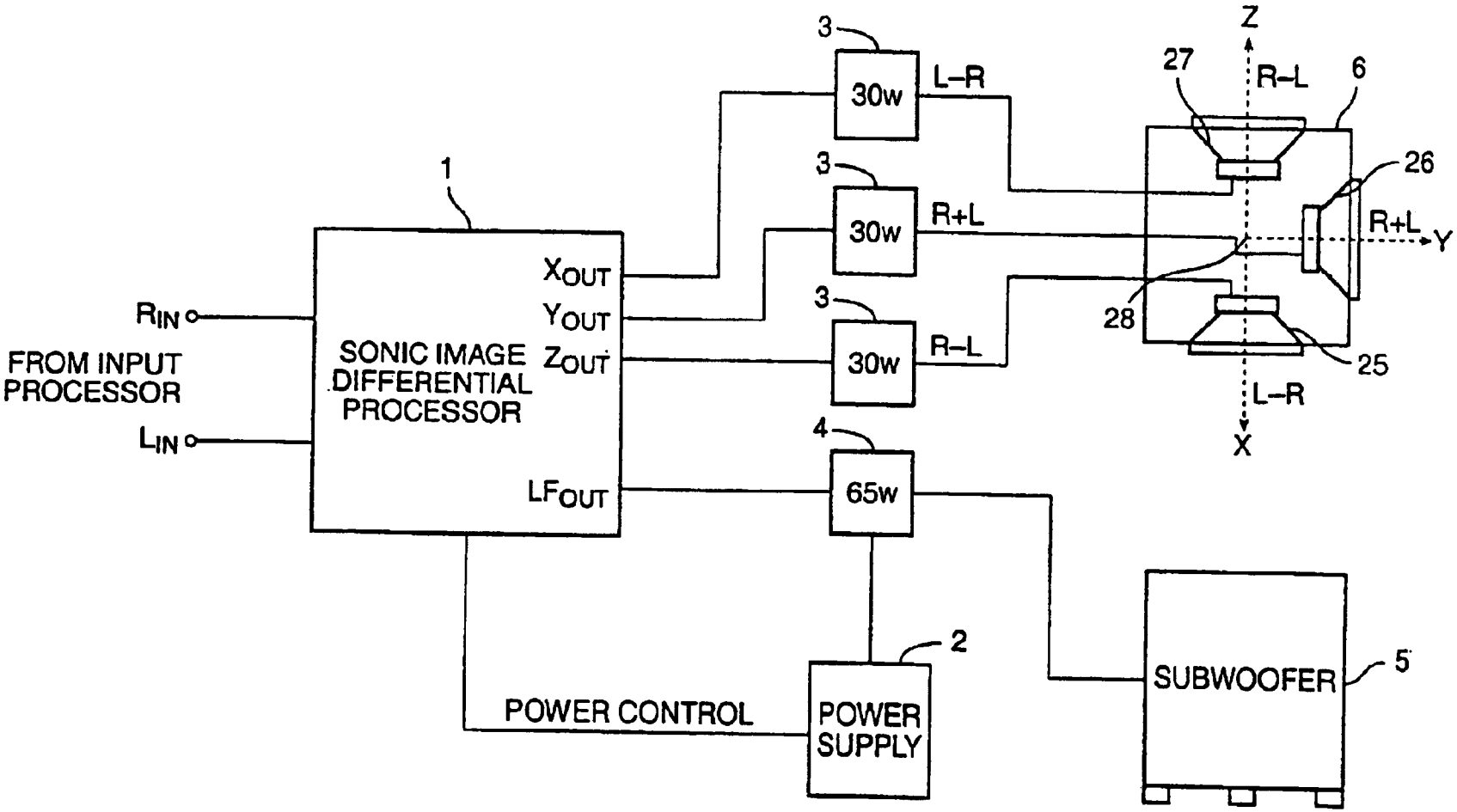
FIG. 1 is a block diagram of the preferred embodiment including a top plan view of the point source speaker enclosure.

The major components of preferred embodiment is shown in FIG. 1. These components include sonic image differential processor 1, power supply 2, three 30 watt amplifiers 3, one 65 watt subwoofer amplifier 4, subwoofer 5, and point source speaker enclosure 6. Some image processor 1 receives left and right stereo input signals (L and R) from input process 7. The structure and function of input processor 7 is discussed below with respect to FIG. 2.

As depicted in FIG. 1, sonic image differential processor 1 has two inputs for the L and R signals from input processor 6, and four outputs to amplifiers 3 and 4. The output signal from each of amplifiers 3 is input to one of the three speakers in point source speaker enclosure 6. Point source speaker enclosure 6 contains three speakers in a tri-axial (X,Y,Z axes) arrangement to form a tri-axial interferometric transducer array. The output signal from subwoofer amplifier 4 is input to subwoofer 5. Power is provided by power supply 2.

In operation, sonic image differential processor 1 processes the L and R signals within the interferometric frequency range in accordance with the interferometric properties of the preferred embodiment. In particular, L and R signals are processed into three channels, one for each of the three axes (X, Y, Z) of point source speaker enclosure 6, and output to amplifiers 3 via outputs Xout , Yout and Zout as L−R, R+L and R−L, respectively. The L−R, R+L and R−L signals are then amplified by amplifiers 3 and input to the X, Y and Z (left, center and right) speakers, respectively, in point source speaker 6. L and R signals below the interferometric range are output from Sonic image differential processor 1 via line feed (LF out), then amplified by subwoofer amplifier 4 and input to subwoofer 5.

Figure 2:
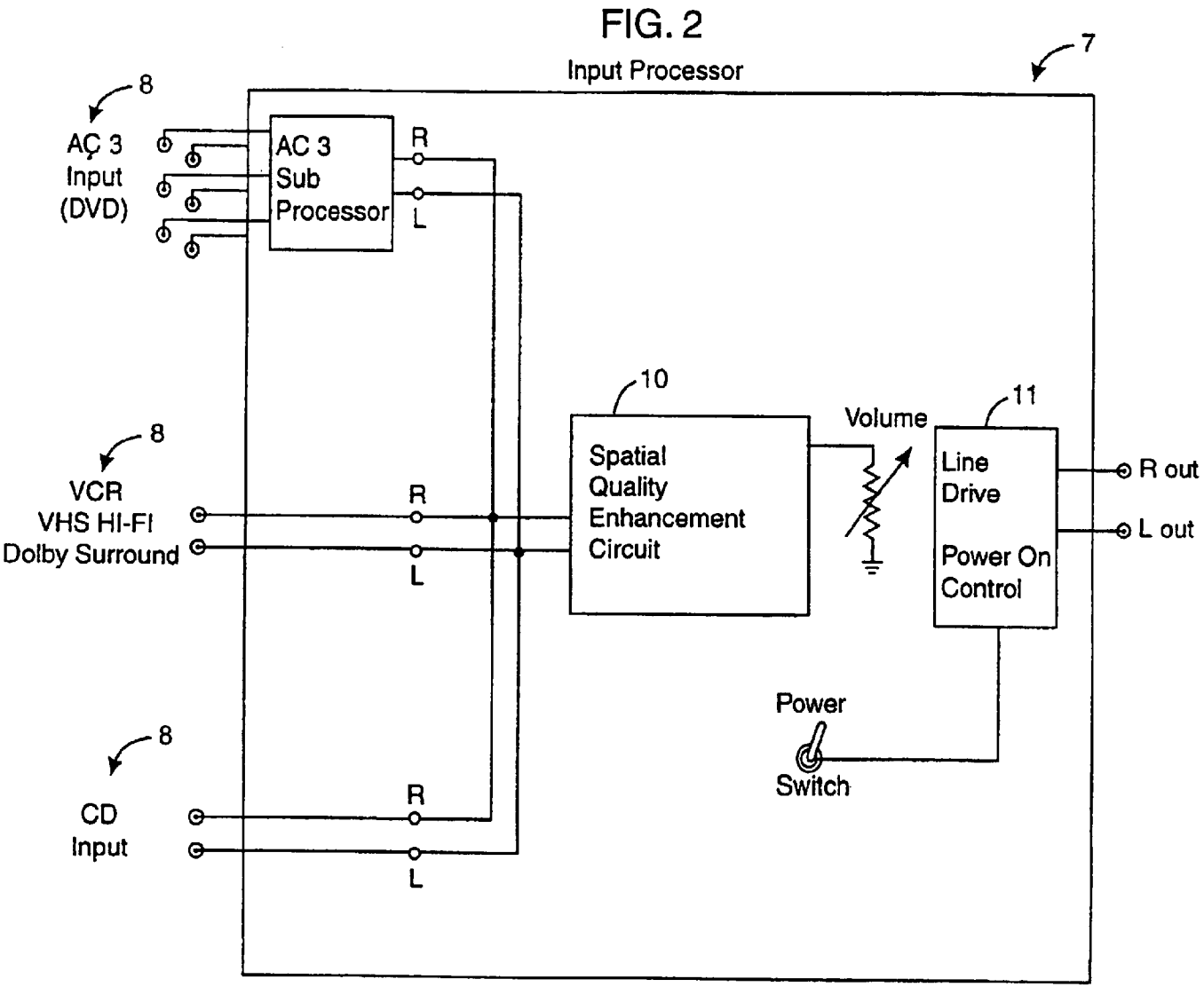
FIG. 2 is a block diagram of the input signal processor used with the preferred embodiment.

The function of input processor 7 is to simply re-process the signals from a given acoustic source 8 (such as a DVD, VCR or CD) for input to sonic image differential processor 1 and the structure may take many forms. In the preferred embodiment as shown in FIG. 2, input processor 7 includes AC 3 subprocessor 9 for an AC3 input (DVD), spatial quality enhancement circuit 10, line drive/power-on control circuit 11. Spatial quality enhancement circuit 10 may be any type of signal enhancement such as Dolby 4-2-4.

Figure 3:
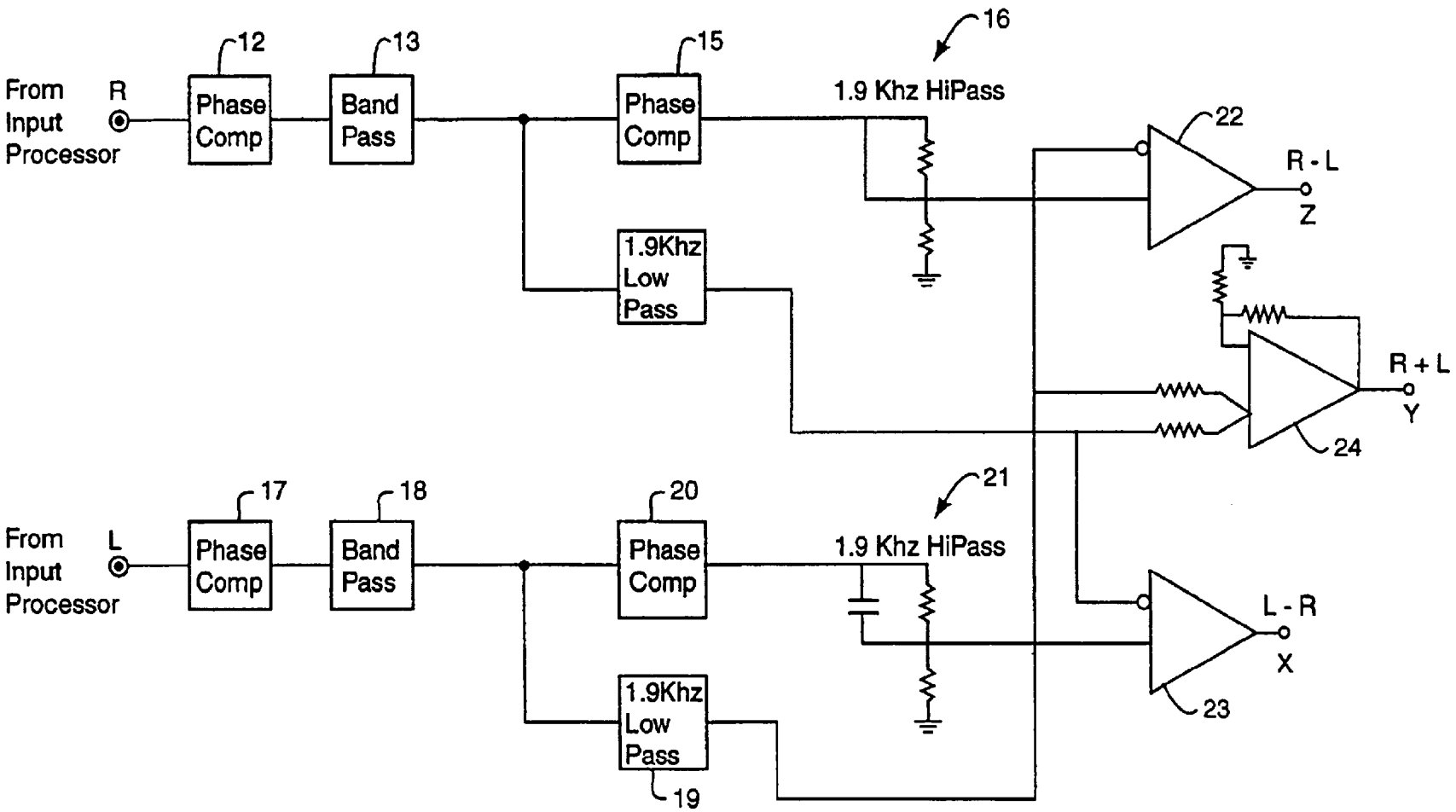
FIG. 3 is a schematic diagram of the sonic image differential processor in the preferred embodiment.

Sonic image differential processor 1 is depicted in detail in FIG. 3. As shown, the L and R signals are input to sonic image differential processor 1 from input processor 7 and processed in parallel by identical circuitry. Accordingly, the circuitry is discussed in detail only with respect to one of the channels.

Signal R is first processed by Fourier phase compensation circuit 12. Next the signal is filtered by third order band pass filter 13 with a low cut-off at 136 Hz and a high cut-off at 35 KHZ. The frequencies in the L and R signals below 136 Hz are produced by subwoofer 5 only. The output from band pass filter 13 is then passed to third order low pass filter 14 with a cut-off of 1.9 KHz, which defines the high end of the frequency band which is interferometricly processed. (i.e., processed into the L−R, R+L and R−L signals). This band is referred to herein as the interferometric frequency band. The low end cut-off of band pass filter defines the low end of the interferometric frequency band or interferometric domain.

Note, that the ideal interferometric frequency band is dependant on the size and proximity of the speakers in point source speaker enclosure 6. The values for the interferometric frequency band utilized in the preferred embodiment are chosen in accordance with the particular speaker size and distance of the speaker in point source speaker enclosure as depicted in FIG. 1.

The output from band pass filter 13 is also processed by a phase delay compensator 15 to compensate for the delay in low pass filter 14. The output from phase delay compensator is then processed by shelving filter 16 (i.e., high pass filter) which increases the gain on the signal above 1.9 KHz. The frequency shelf of shelving filter 16 is chosen to match the frequency of low pass filter 14. Thus, shelving filter 16 serves to increase the gain on signal R above, the interferometric frequency band. This boost of the signal above 1.9 KHz since the R and L signals above the interferometric frequency band are not produced by the center speaker in point source speaker enclosure 6. Thus, only frequencies within the interferometric domain are produced by all three speakers in point source speaker enclosures 6.

The output from shelving filter 16 (R signal) and the inverted output from low pass filter 19 (−L signal) are input to operational amplifier (op amp) 22. This results in signal R−L from op amp 22. Likewise, the output from shelving filter 21 (L signal) and the inverted output from low pass filter 14 (−R signal) are input to op amp 22. This results in signal L−R from op amp 23. Additionally, the output from low pass filter 14 (R signal) and the output from low pass filter 19 (L signal) are input to op amp 24. This results in signal R+L for the interferometric frequency band only.

In the preferred embodiment, sonic image differential processor 1 is comprised of analog circuitry. However, one of ordinary skill could readily implement the identical functionality using digital circuitry such as a DSP (digital signal processor).

Figure 4:
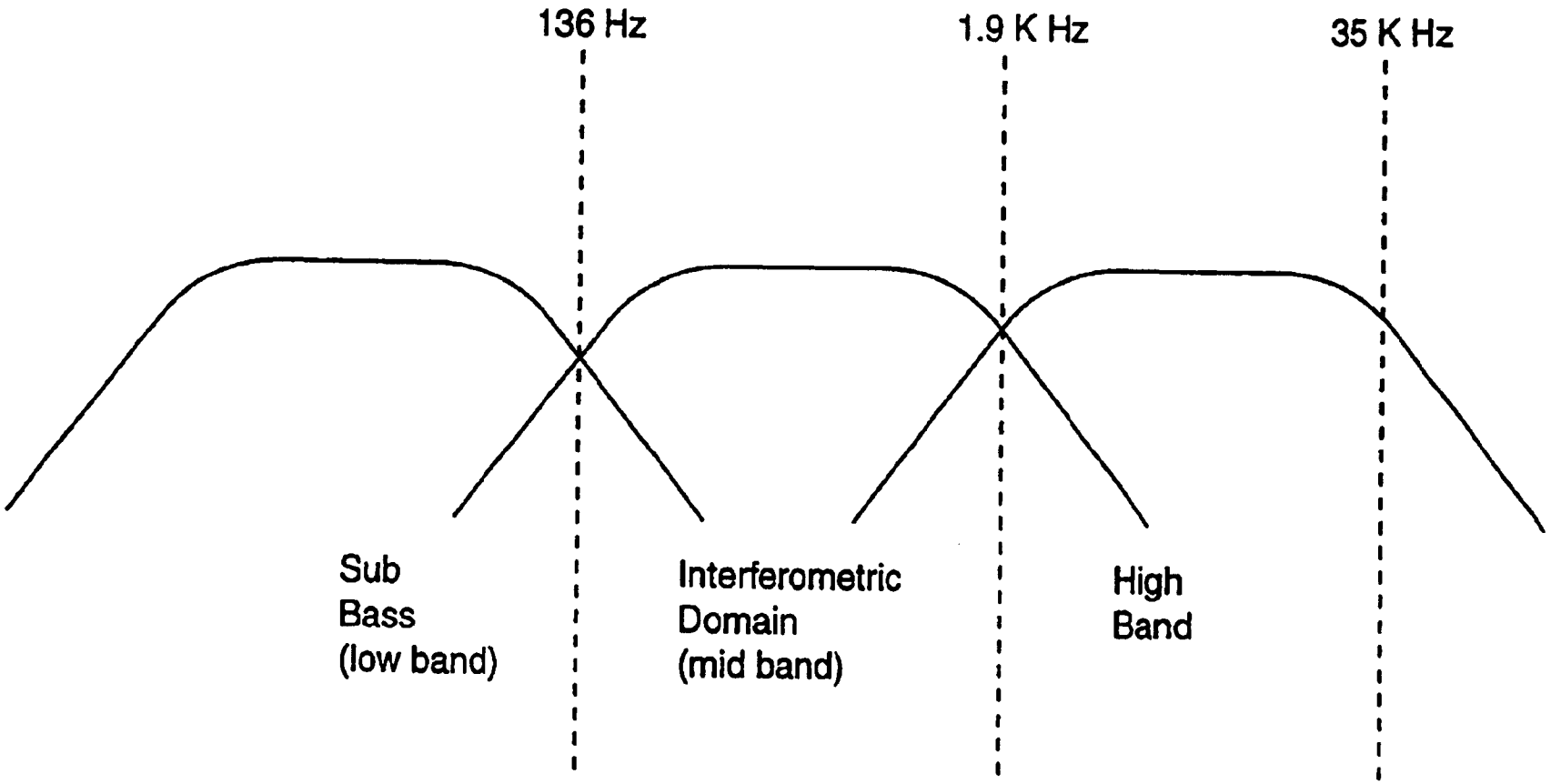
FIG. 4 is an illustrative diagram demonstrating the interferometric domain of the present invention.

The frequency processing bands of the preferred embodiment are depicted in FIG. 4. The sub bass or low band domain is below 136 Hz. The interferometric frequency band or mid band domain is between 136 Hz and 1.9 KHz. The high band domain is between 1.9 KHz and 35 KHz. As previously discussed the most effective values are dependent on the size and distance of the speakers in point source speaker enclosure 6.

Point source speaker enclosure 6 is depicted in detail in FIG. 1 and is configured as a box to house speakers 25, 26 and 27. The walls of point source speaker enclosure 6 are formed of a sturdy material such as wood in order to arrange speakers 25, 26 and 27 as close together as possible. A sturdy material is required since the magnets contained in each of speakers 25, 26 and 27 will create a force pushing speakers 25, 26 and 27 apart. The closer speakers 25, 26 and 27 are together, the higher the high end of the interferometric domain. This is advantageous in that it allows use of the interferometric properties of the present invention over a greater frequency range.

Generally, the smaller the speaker the smaller the distance between speakers 25, 26 and 27 and the wider the interferometric domain. The preferred embodiment employs three 3" speakers and a subwoofer.

Alternate configurations are also possible. For example, speakers 25, 26 and 27 may be 4 ½" speakers without a subwoofer. A combination point source speaker enclosure housing six speakers is also possible. Such a system would include three smaller speakers such as 3" speakers for the upper end of the interferometric domain and three larger speakers such as 4 ½" speakers for the lower end of the interferometric domain.

Speakers 25 (left), 26 (center) and 27 (right) are triaxially housed one each in point source speaker enclosure 6 along the X (left), Y (center) and Z (right) axes, respectively. That is, left and right speakers 25 and 27 are each arranged along an axis 90° from the axis of center speaker 26. Further, left and right speakers 25 and 27 are arranged along axes 180° from each other, i.e., in opposing directions. The effect of arranging speakers 25, 26 and 27 in such a manner is to have the acoustic wave from each of speakers 25, 26 and 27 emanating from a single point of origin 28, hence a point source.

The most expedient shape for point source speaker enclosure 6 is a cube having all six panels of equal size. However, alternate sizes and shapes are possible. In order to provide the best results, speakers 25, 26 and 27 should be placed as close together as possible and the axis of each speaker should intersect at a common point of origin 28.

In the preferred embodiment, point source speaker enclosure 6 is 5 ¼" wide, 5 ½" tall and 4 ¼" deep. The shorter depth allows placement of point source speaker enclosure 6 on top of a particular model of a Sharp flat panel television.

Additionally, point source speaker enclosure is filled with fiber glass to absorb all of the high frequency (HF) backwaves from speakers 25, 26 and 27.

Speakers 25, 26 and 27 are coupled to sonic image differential processor 1 such that left speaker 25 is coupled to op amp 23, center speaker 26 is coupled to op amp 24 and right speaker 27 is coupled to op amp 21. As a result, signal L−R is emitted from left spear 25, signal R+L is emitted from center speaker 26 and signal R−L is emitted from right speaker 27.

From the above description, it will be apparent that the invention disclosed herein provides a novel and advantageous hybrid data transmission system. The foregoing discussion discloses and describes merely exemplary methods and embodiments of the present invention. One skilled in the art will readily recognize from such discussion that various changes, modifications and variations may be made therein without departing from the spirit and scope of the invention. Accordingly, disclosure of the present invention is intended to be illustrative, but not limiting, of the scope of the invention, which is set forth in the following claims.

I claim:

1. A point source speaker system, comprising:

means for processing left (L) and right (R) audio signals to produce a left minus right (L−R) audio signal having a frequency range below a first pre-determined maximum frequency, a right plus left (R+L) audio signal having a frequency range below a second pre-determined maximum frequency, a right minus left (R−L) audio signal having a frequency range below a third pre-determined maximum frequency, an amplified left audio signal having a frequency range above said first pre-determined maximum frequency, and an amplified right audio signal having a frequency range above said third pre-determined maximum frequency;

a housing;

a first speaker coupled to said processing means to receive said L−R audio signal and said amplified left audio signal;

a second speaker coupled to said processing means to receive said R+L audio signal; and a third speaker coupled to said processing means to receive said R−L audio signal and said amplified right audio signal;

wherein said first, second and third speakers are enclosed within said housing.

2. The point source speaker system recited in claim 1 wherein a magnetic force is created by the speakers being arranged in closest proximity and said housing prevents the magnetic force from pushing the speakers apart.

3. The point source speaker system recited in claim 1, wherein the first, second and third pre-determined maximum frequency are 1.9 KHz.

4. The point source speaker system recited in claim 1, wherein said frequency range of said (L−R) audio signal, said frequency range of said (R+L) audio signal, and said frequency range of said (R−L) audio signal are above a pre-determined minimum frequency.

5. The point source speaker system recited in claim 1, wherein the axis of each said speaker have a common point of origin.

6. The point source speaker system of claim 5, wherein said left and right axes are 90° from the center axis, and said left and right axes are 180° from each other.

7. A point source speaker system for producing stereophonic sound based upon left (L) and right (R) audio signals, comprising:

a first speaker which produces a L−R acoustic wave comprising said left minus said right (L−R) audio signals below a first pre-determined maximum frequency and said left audio signal amplified above said first pre-determined maximum frequency;

a second speaker which produces a R+L acoustic wave comprising said right plus said left (R+L) audio signals below a second pre-determined maximum frequency; and a third speaker which produces a R−L acoustic wave comprising said right minus said right (R−L) audio signals below a third predetermined maximum frequency and said right audio signal amplified above said third pre-determined maximum frequency.

8. The point source speaker system of claim 7 further comprising:

a housing wherein the first, second, and third speakers are enclosed in said housing.

9. The point source speaker system of claim 8, wherein said first, second and third speakers are arranged in said housing such that the axes of the acoustic waves produced by each of the speakers have a common point of origin.

10. The point source speaker system of claim 9, wherein the axes of the L−R and R−L acoustic waves are 90° from the axis of the R+L acoustic wave, and said axes of the L−R and R−L acoustic waves are 180° from each other.

11. The point source speaker system recited in claim 8, wherein a magnetic force is created by the speakers being arranged in closest proximity and said housing prevents the magnetic force from pushing the speakers apart.

12. The point source speaker system of claim 10, further comprising:

a signal processor, wherein said signal processor processes said left and right audio signals to produce said L−R signal, said R+L signal and said R−L signal.

13. The point source speaker system recited in claim 7, wherein the first, second and third pre-determined maximum frequency are 1.9 KHz.

14. The point source speaker system recited in claim 7, wherein said L−R acoustic wave, said R+L acoustic wave, and R−L acoustic wave are above a pre-determined minimum frequency.

15. The point source speaker system recited in claim 7, wherein the axis of each said speaker have a common point of origin.

16. A method for providing stereophonic sound based upon left (L) and right (R) audio signals from a point source, comprising the steps of:

producing a left minus right (L−R) audio signal having a frequency range below a first pre-determined maximum frequency from said left and right audio signals;

producing a right plus left (R+L) audio signal having a frequency range below a second predetermined maximum frequency from said left and right audio signals;

producing a right minus left (R−L) audio signal having a frequency range below a third pre-determined maximum frequency from said left and right audio signals;

producing an amplified left audio signal having a frequency range above said first pre-determined maximum frequency;

producing an amplified right audio signal having a frequency range above said third pre-determined maximum frequency;

generating a L−R acoustic wave along a left axis from said L−R audio signal and said amplified left audio signal;

generating a R+L acoustic wave along a center axis from only said R+L audio signal; and generating a R−L acoustic wave along a right axis from said R−L audio signal and said amplified right audio signal.

17. The method recited in claim 16, wherein the first, second and third pre-determined maximum frequency are 1.9 KHz.

18. The method recited in claim 16, wherein said frequency range of said (L−R) audio signal, said frequency range of said (R+L) audio signal, and said frequency range of said (R−L) audio signal are above a pre-determined minimum frequency.

19. The method recited in claim 16, wherein said left, right and left axes have a common point of origin and said L−R, R+L and R−L acoustic waves originate from speakers arranged in a single housing.

20. The method recited in claim 19, wherein said left and right axes are 90° from the center axis, and said left and right axes are 180° from each other.

21. The method recited in claim 19, wherein a magnetic force is created by the speakers being arranged in closest proximity and said housing prevents the magnetic force from pushing the speakers apart.

22. A point source speaker system, comprising:

means for processing left (L) and right (R) audio signals to produce a first audio signal including the left minus right (L−R) audio signal below a first pre-determined maximum frequency and excluding said right audio signal above said first pre-determined maximum frequency, a second audio signal comprising the right plus left (R+L) audio signal below a second predetermined maximum frequency and a third audio signal including the right minus left (R−L) audio signal below a third pre-determined maximum frequency and excluding said left audio signal above said third pre-determined maximum frequency;

a housing;

a first speaker coupled to said processing means to receive said first audio signal;

a second speaker coupled to said processing means to receive un-multiplied said second audio signal; and a third speaker coupled to said processing means to receive said third signal;

wherein said first, second and third speakers are enclosed within said housing.

23. The point source speaker system recited in claim 22, wherein the first, second and third pre-determined maximum frequency are 1.9 KHz.

24. The point source speaker system recited in claim 22, wherein said frequency range of said first audio signal, said frequency range of said second audio signal, and said frequency range of said third audio signal are above a pre-determined minimum frequency.

25. The point source speaker system recited in claim 22, wherein the axis of each said speaker have a common point of origin.

26. A point source speaker system for producing stereophonic sound based upon left (L) and right (R) audio signals, comprising:

a first speaker which produces a L−R acoustic wave including said left minus said right (L−R) audio signals below a first pre-determined maximum frequency and excluding said right audio signal above said first pre-determined maximum frequency;

a second speaker which produces a R+L acoustic wave comprising said right plus said left (R+L) audio signals below a second pre-determined maximum frequency;

a third speaker which produces a R−L acoustic wave including said right minus said right (R−L) audio signals below a third pre-determined maximum frequency and excluding said left audio signal above said third pre-determined maximum frequency; and a housing;

wherein said first, second and third speakers are enclosed within said housing.

27. The point source speaker system recited in claim 26, wherein the first, second and third pre-determined maximum frequency are 1.9 KHz.

28. The point source speaker system recited in claim 26, wherein said L−R acoustic wave is above a pre-determined minimum frequency; said R+L acoustic wave is above said pre-determined minimum frequency; and said R−L acoustic wave is above said pre-determined minimum frequency.

29. The point source speaker system recited in claim 26, wherein the axis of each said speaker have a common point of origin.

* * * * *